US010280914B2

(12) United States Patent
Han et al.

(10) Patent No.: US 10,280,914 B2
(45) Date of Patent: May 7, 2019

(54) LINEAR COMPRESSOR

(71) Applicant: LG ELECTRONICS INC., Seoul (KR)

(72) Inventors: Youngcheol Han, Seoul (KR); Donghan Kang, Seoul (KR); Joonsung Park, Seoul (KR); Kwangwoon Ahn, Seoul (KR); Sanghyun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 93 days.

(21) Appl. No.: 15/585,394

(22) Filed: May 3, 2017

(65) Prior Publication Data

US 2017/0321684 A1 Nov. 9, 2017

(30) Foreign Application Priority Data

May 3, 2016 (KR) ..... 10-2016-0054904

(51) Int. Cl.

| | |
|---|---|
| ***F16J 10/02*** | (2006.01) |
| ***F04B 39/12*** | (2006.01) |
| ***F04B 35/04*** | (2006.01) |
| ***F04B 39/02*** | (2006.01) |

(52) U.S. Cl.

CPC ..... *F04B 39/127* (2013.01); *F04B 35/04* (2013.01); *F04B 35/045* (2013.01); *F04B 39/0292* (2013.01); *F04B 39/122* (2013.01)

(58) Field of Classification Search

CPC ..... F04B 39/122; F04B 39/127

USPC ..... 92/84, 140; 417/417

See application file for complete search history.

(56) References Cited

U.S. PATENT DOCUMENTS 9,863,410 B2 * 1/2018 Kim ..... F04B 39/122

FOREIGN PATENT DOCUMENTS

| | | |
|---|---|---|
| CN | 104454445 | 3/2015 |
| CN | 105298793 | 2/2016 |
| CN | 105298801 | 2/2016 |
| CN | 107304759 | 10/2017 |
| EP | 2 848 810 | 3/2015 |
| KR | 10-1307688 | 9/2013 |
| KR | 10-2016-0000324 | 1/2016 |
| KR | 10-2016-0001055 | 1/2016 |

OTHER PUBLICATIONS

European Search Report dated Oct. 26, 2017.
Chinese Office Action dated Jul. 4, 2018 issued in Application No. 201710221027.7 (English Translation Attached).

* cited by examiner

*Primary Examiner* — Michael Leslie
(74) *Attorney, Agent, or Firm* — Ked & Associates LLP

(57) ABSTRACT

A linear compressor is provided. The linear compressor may include a cylinder; a frame coupled to an outer side of the cylinder; a cylinder groove defined on an outer circumferential surface of the cylinder; and a sealing member provided in the cylinder groove. The sealing member may be provided between the outer circumferential surface of the cylinder and an inner circumferential surface of the frame.

20 Claims, 15 Drawing Sheets

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0054904, filed in Korea on May 3, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this the cooling system includes a compressor, a condenser an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas s suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between, an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR", which is hereby incorporated by reference. In the linear compressor of the Prior Art Document 2 a gas bearing technology in which a refrigerant gas is supplied in a space between a cylinder and a piston to perform a bearing function is disclosed. The refrigerant gas flows to an outer circumferential surface of the piston through a nozzle of the cylinder to act as a bearing in the reciprocating piston.

On the other hand, the linear compressor of the Prior Art Document 2 defines a sealing pocket between a cylinder and a frame and includes a sealing member movably installed in the sealing pocket. That is, the sealing pocket is formed to have a size larger than a cross-sectional area of the sealing member, and the sealing member is moved by a pressure of the gas bearing to close an end of the sealing pocket.

Due to such a structure, when the linear compressor operates for a long time, the sealing member is relatively greatly exposed to the gas bearing, causing shrinkage deformation due to heat. Thus, the sealing pocket may not be sealed and refrigerant may leak out. Also, the sealing member is loosened in a space between the cylinder and the frame.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope will fully convey the concept to those skilled in the art.

Figure 1:
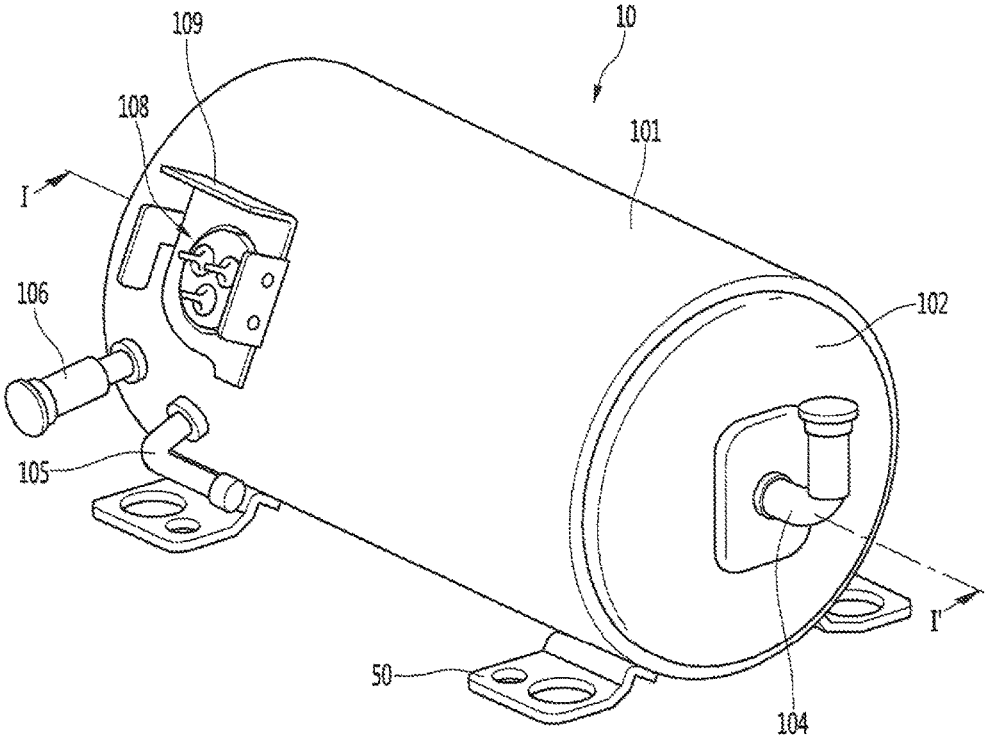
FIG. 1 is a perspective view illustrating an outer appearance of a linear compressor according to an embodiment.
Figure 2:
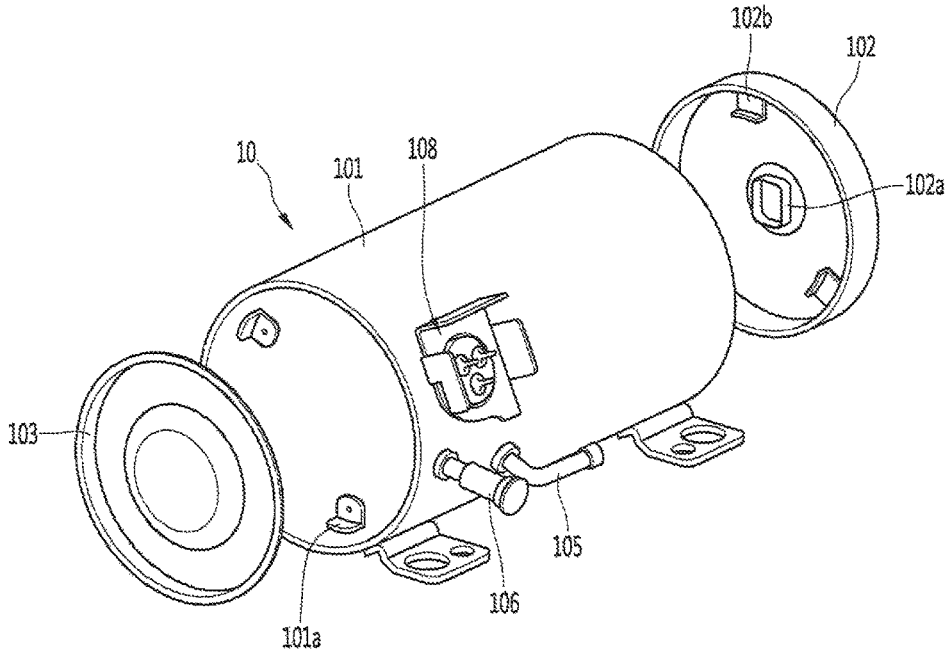
FIG. 2 is an exploded perspective view of a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge, pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into a piston 130 to improve compression performance of the refrigerant. The oil may be understood as working oil existing in a cooling system.

A cover support part or support 102*a* may be disposed or provided on an inner surface of the first shell cover 102. A second support device or support 185, which will be described hereinafter may be coupled to the cover sup port part 102*a*. The cover support part 102*a* and the second support device 185 may be understood as devices that support a main body of the linear compressor 10. The main body of the compressor may represent a part or portion provided in the shell 101. For example, the main body may include a drive part or drive that reciprocates forward and backward and a support part or support that supports the drive part. The drive part may include parts or components, such as the piston 130, a magnet frame 138, a permanent magnet 146, a support 137, and a suction muffler 150. Also, the support part may include parts or components, such as resonant springs 176*a* and 176*b*, a rear cover 170, a stator cover 149, a first support device or support 165, and a second support device or support 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position which is adjacent to the second shell cover 103. The spring coupling part 101*a* may be coupled to a first support spring 166 of the first support device 165, which will be described hereinafter. As the spring coupling part 101*a* and the first support device 165 are coupled to each other, the main body of the compressor may be stably supported inside of the shell 101.

Figure 3:
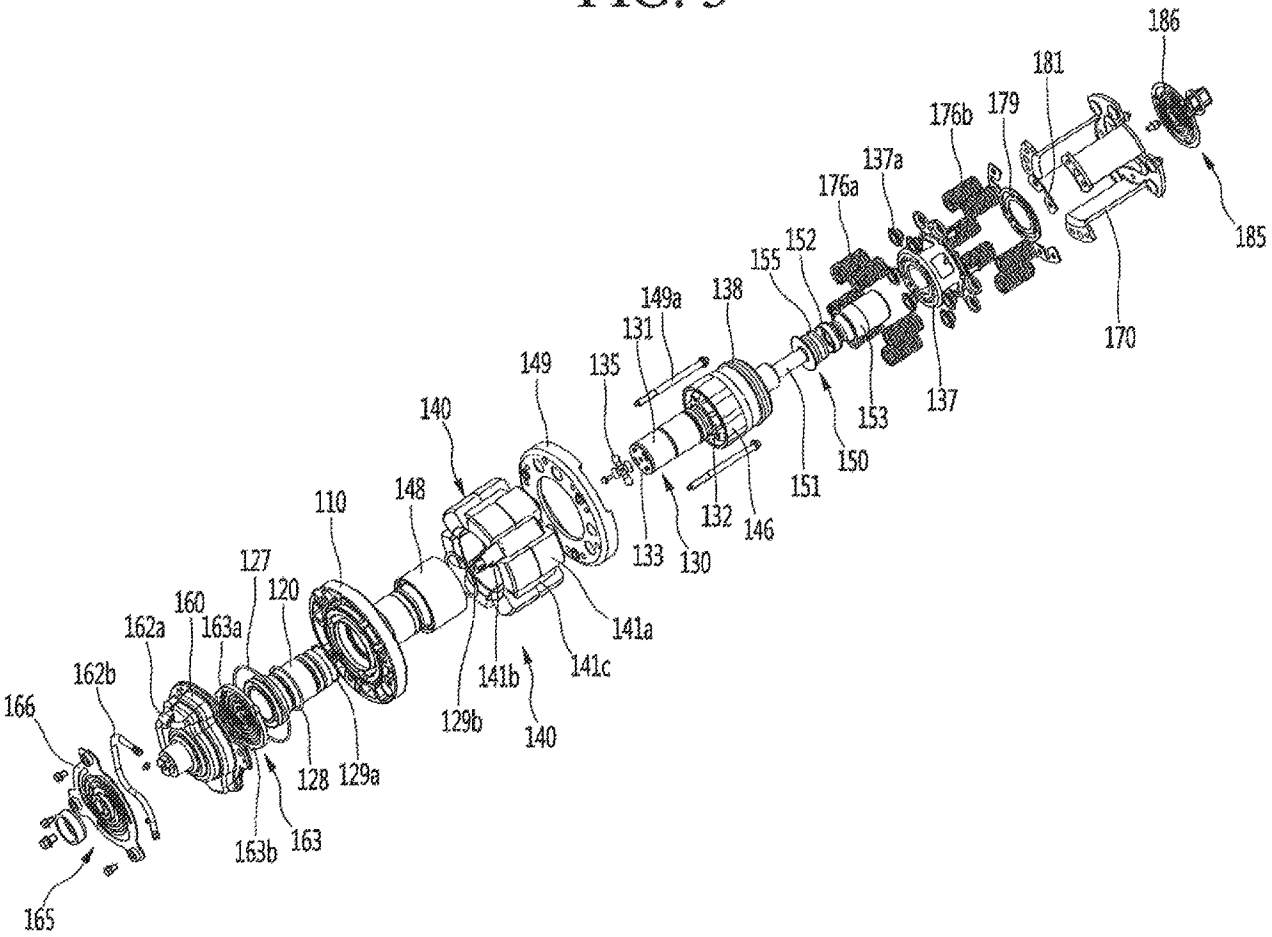
FIG. 3 is an exploded perspective view illustrating internal parts or components of the linear compressor according to an embodiment.
Figure 4:
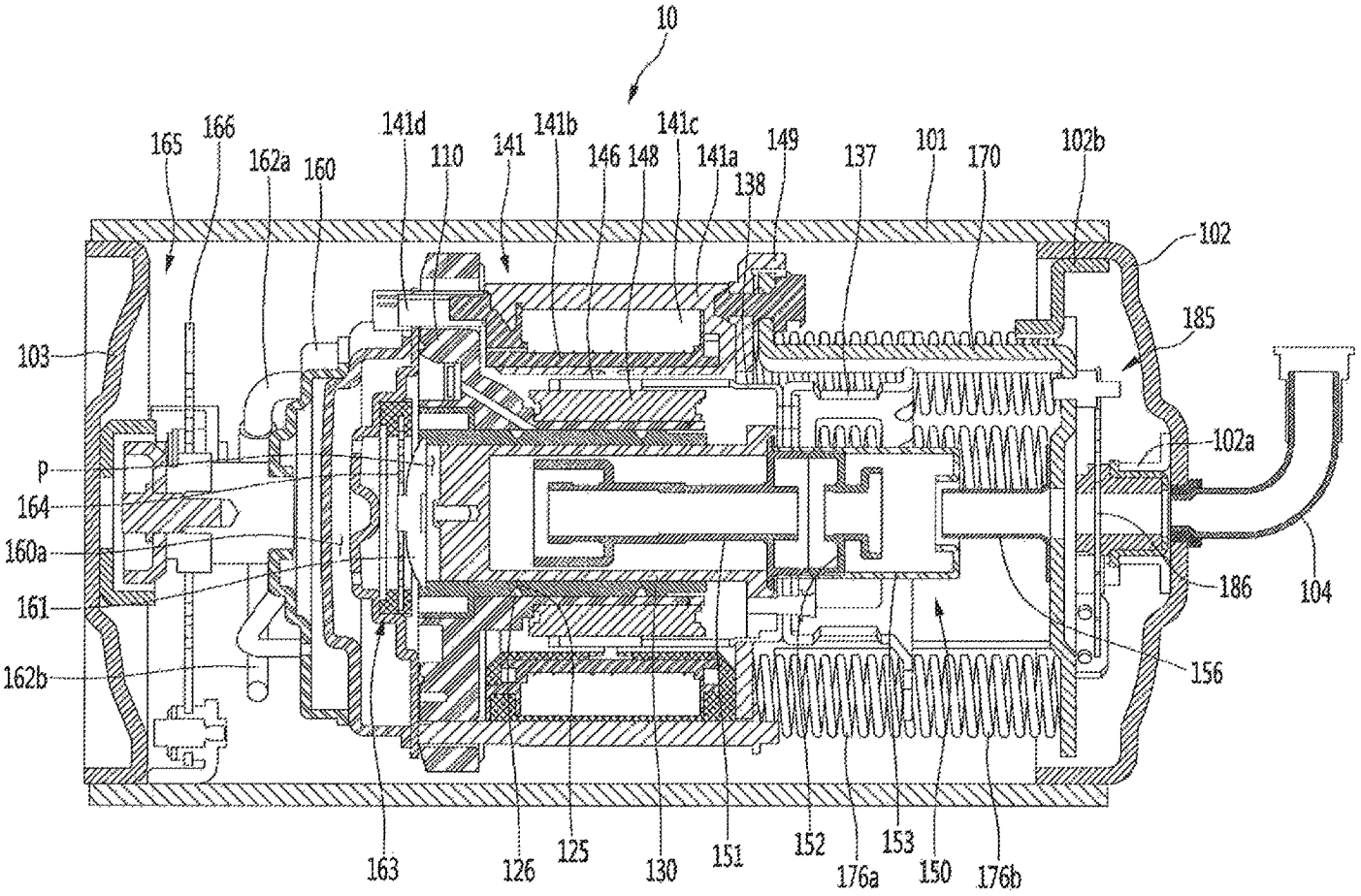
FIG. 4 is a cross-sectional view, taken along line I-I' of FIG. 1.

FIG. 3 is an exploded perspective view illustrating internal components of the linear compressor according to an embodiment. FIG. 4 is a cross-sectional view illustrating internal components of the linear compressor according to an embodiment.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151, 152, and 153. The plurality of mufflers 151, 152, and 153 may include a first muffler 151, second muffler 152, and a third muffler 153, which may be coupled to each other.

The first muffler 151 may be disposed or provided within the piston 130, and the second muffler 152 may be coupled to a rear portion of the first muffler 151. Also the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 that defines a discharge space 160*a* for the refrigerant discharged from the compression space P and a discharge valve assembly 161 and 163 coupled to the discharge cover 160 to selectively discharge the refrigerant compressed in the compression space P may be provided at a front side of the compression space P. The discharge space 160*a* may include a plurality of space parts or spaces which may be partitioned by inner walls of the discharge cover 160. The plurality of space parts may be disposed or provided in the frontward and re sward direction to communicate with each other.

The discharge valve assembly 161 and 163 may include a discharge valve 161 which may be opened when the pressure of the compression space P is above a discharge pressure to introduce the refrigerant into the discharge space and a spring assembly 163 disposed or provided between the discharge valve 161 and the discharge cover 200 to provide an elastic force in the axial direction. The spring assembly 163 may include a valve spring 163*a* and a spring support part or support 163*b* that supports the valve spring 163*a* to the discharge cover 200. For example, the valve spring 163*a* may include a plate spring. Also, the spring support part 163*b* may be integrally injection-molded to the valve spring 163*a* through an injection-molding process, for example.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 200. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 200 to discharge the refrigerant flowing through the discharge space of the discharge cover 200. For example, the cover pipe 162*a* may be made of a metal material.

Also, the linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side or end coupled to the cover pipe 162*a* and the other or a second side or end coupled to the discharge pipe 105.

A cover coupling part or portion 162*c* coupled to the cover pipe 162*a* is disposed on the one side portion of the loop pipe 162*b*, and a discharge coupling part or portion 162*d* coupled to the discharge pipe 105 may be disposed or provided on the other side portion of the loop pipe 162*b*.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 is understood as a component for fixing the cylinder 120. For example, the cylinder 120 may be press-fitted into the frame 110. Each of the cylinder 120 and the frame 110 may be made of aluminum or an aluminum alloy material, for example.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates the piston 130 may reciprocate together with the permanent magnet 146 in the axial direction.

The outer stator 41 may include coil winding bodies 141*b*, 141*c* and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141. The terminal part 141*d* may be inserted into a terminal insertion part or portion (see reference numeral 119*c* of FIG. 6).

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other a second side supported by the stator cover 149.

The linear compressor 10 may further include a cover coupling member 149*a* for coupling the stator cover 49 to the frame 110. The cover coupling member 149*a* may pass through the stator cover 149 to extend forward to the frame 110 and then be coupled to a first coupling hole (not shown) of the frame 110.

The inner stator 148 may be fixed to a circumference of the frame 110. Also, in the inner stator 148 the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to the movement of the drive part. The support 137 may include a first spring support part or support 137*a* coupled to the first resonant spring 176*a*.

The linear compressor 10 may include the frame 110 and a plurality of sealing members or seals 127, 128, 129*a* and 129*b* that increases a coupling force between peripheral parts or components around the frame 110. The plurality of sealing members 127, 128, 129*a*, and 129*b* may include a first sealing member or seal 127 disposed or provided at a portion at which the frame 110 and the discharge cover 160 are coupled to each other. The first sealing member 127 may be disposed or provided on or in a second installation groove (see reference numeral 116*b* of FIG. 6) of the frame 110.

The plurality of sealing members 127, 126, 129*a*, and 129*b* may further include a second sealing member or seal 128 disposed or provided at a portion at which the frame 110 and the cylinder 120 are coupled to each other. The second sealing member 128 may be disposed or provided on or in a first installation groove (see reference numeral 116*a* of FIG. 6) of the frame 110.

The plurality of sealing members 127, 128, 129*a*, and 129*b* may further include a third sealing member or seal 129*a* disposed or provided between the cylinder 120 and the frame 110. The third sealing member 129*a* may be disposed or provided on or in a cylinder groove (see reference numeral 121*e* of FIG. 12) defined in the rear portion of the cylinder 120. The third sealing member 129*a* may prevent external leakage of a refrigerant of a gas pocket (see reference numeral 110*b* of FIG. 12) and function to increase a coupling force between the frame 110 and the cylinder 120.

The plurality of sealing members 127, 128, 129*a*, and 129*b* may further include a fourth sealing member or seal 129*b* disposed or provided at a portion at which the frame 110 and the inner stator 148 are coupled to each other. The fourth sealing member 129*b* may be disposed or provided on or in a third installation groove (see reference numeral 111*a* of FIG. 10) of the frame 110.

Each of the first to fourth sealing members 127, 128, 129*a*, and 129*b* may have a ring shape.

The linear compressor 10 may further include a first support device or support 165 coupled to the discharge cover 160 to support one or a first side of the main body of the linear compressor 10. The first support device 165 may be disposed or provided adjacent to the second shell cover 103 to elastically support the main body of the linear compressor 10. The first support device 165 may include a first support spring 166. The first support spring 166 may be coupled to the spring coupling part 101*a*.

The linear compressor 10 may include a second support device or support 185 coupled to the rear cover 170 to support the other or a second side of the main body of the linear compressor 10. The second support device 185 may be coupled to the first shell cover 102 to elastically support the main body of the linear compressor 10. The second support device 185 may include a second support spring 186. The second support spring 186 may be coupled to the cover support part 102*a*.

Figure 5:
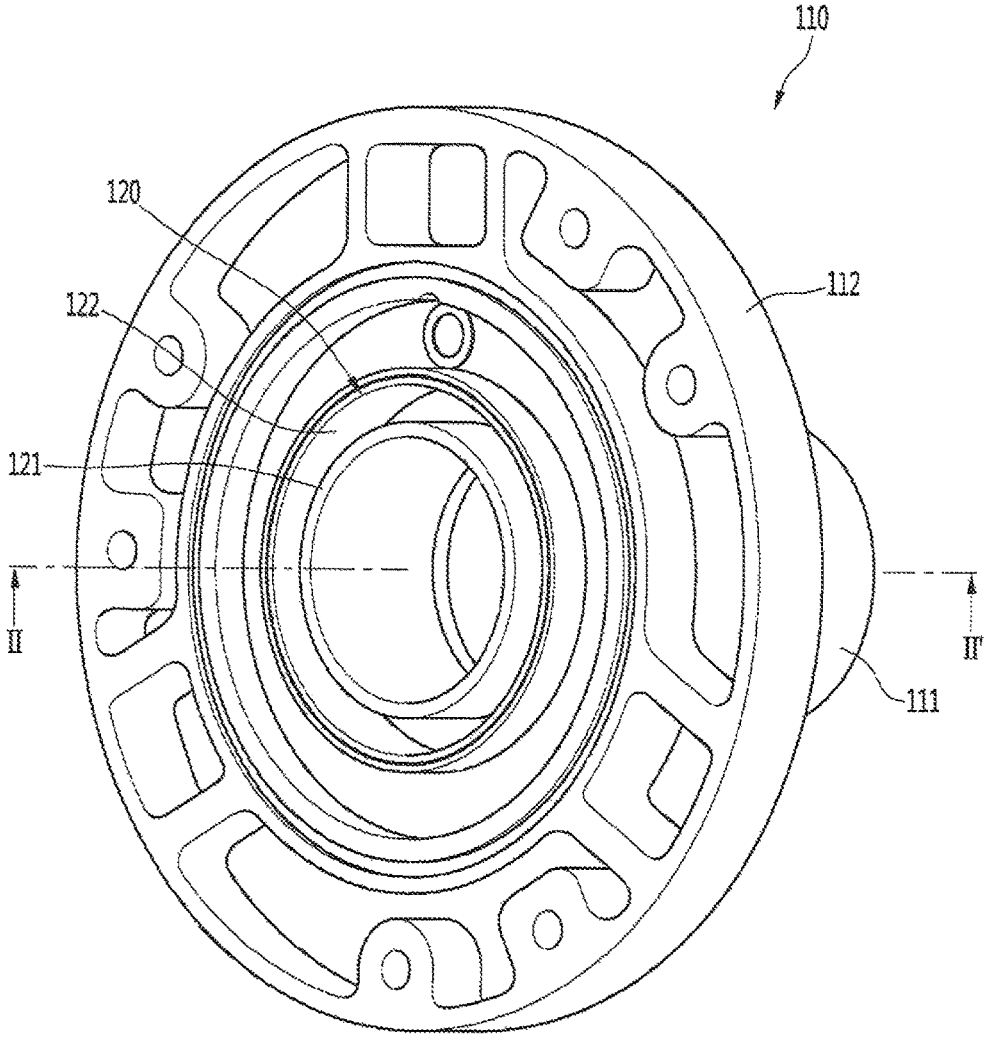
FIG. 5 is a perspective view illustrating a state in which a frame and a cylinder are coupled to each other according to an embodiment.
Figure 6:
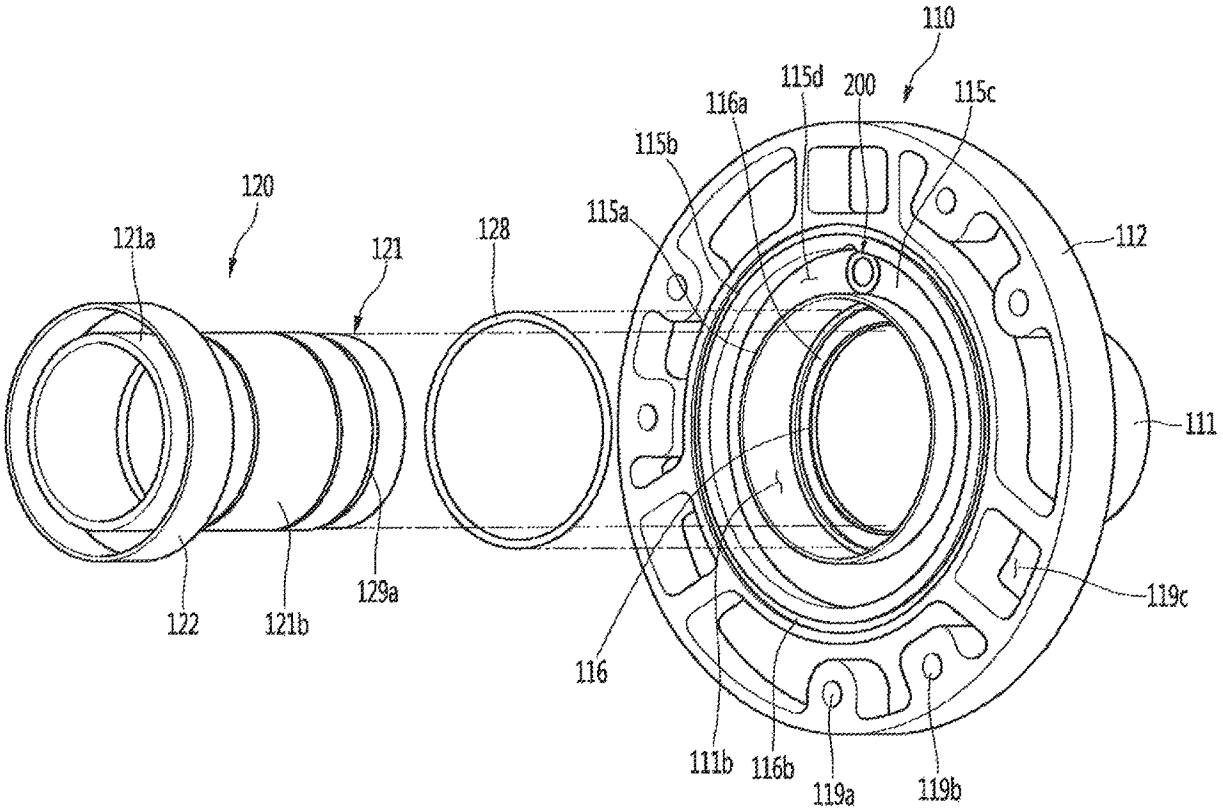
FIG. 6 is an exploded perspective view illustrating the frame and the cylinder according to an embodiment.
Figure 7:
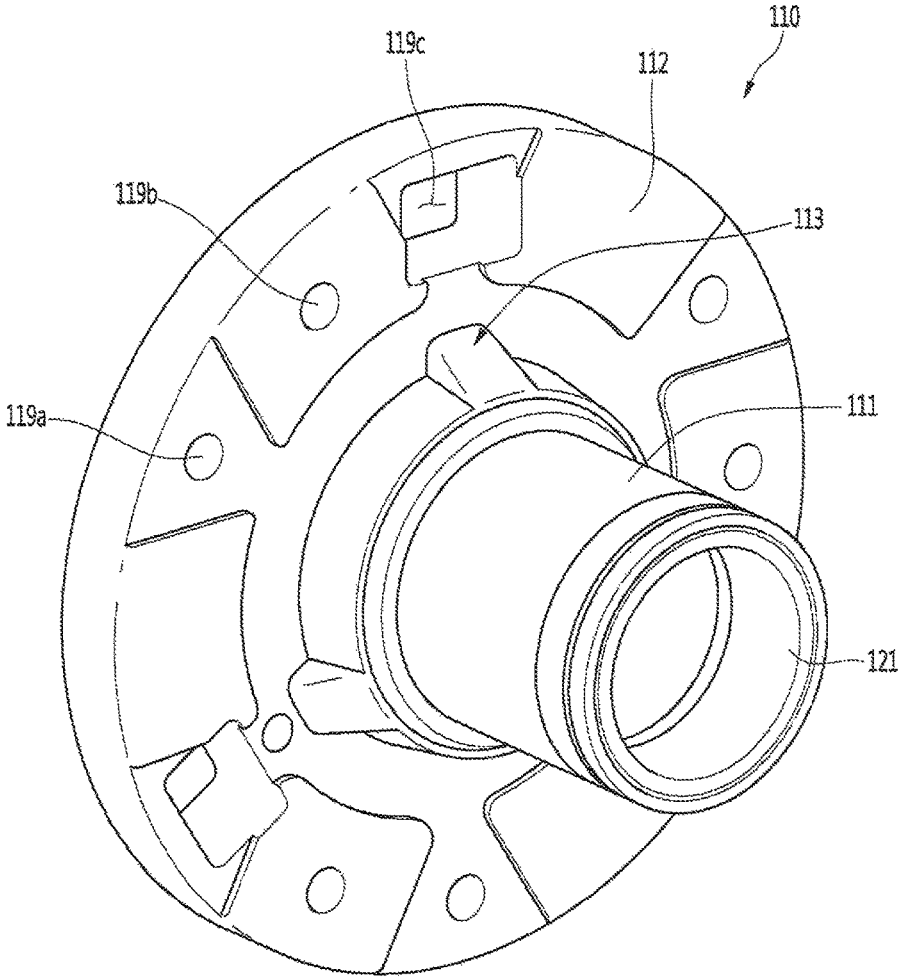
FIG. 7 is a perspective view illustrating a state in which the frame and the cylinder are coupled to each other according to an embodiment.
Figure 8:
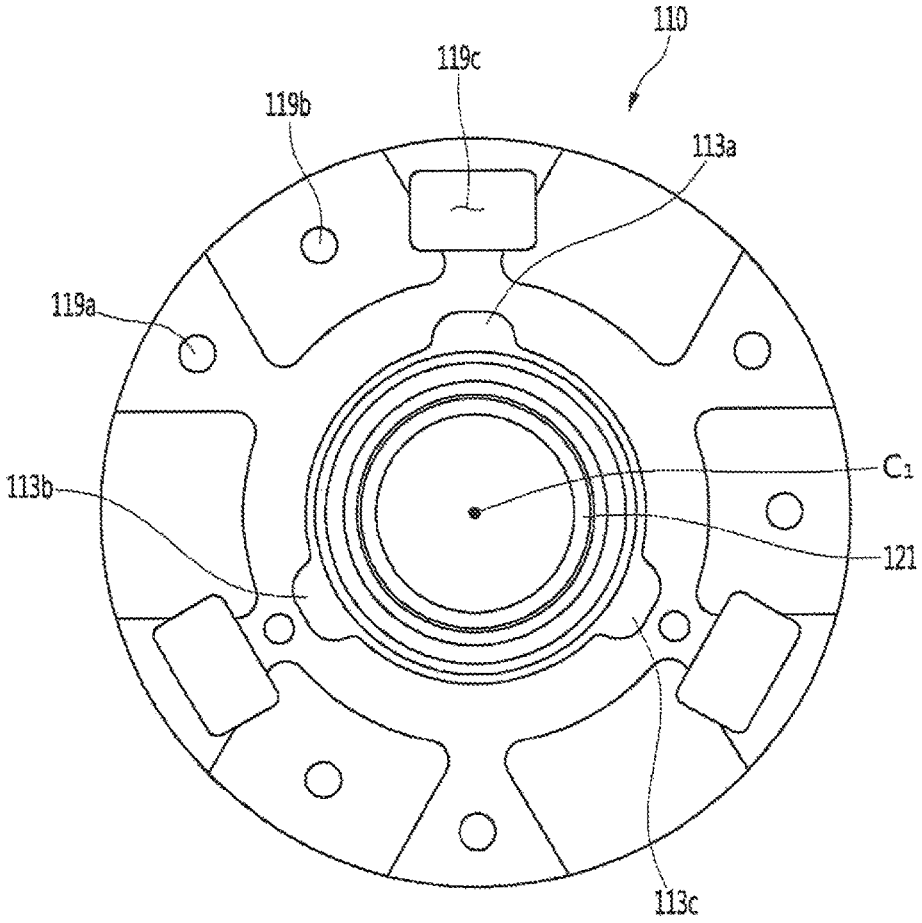
FIG. 8 is a right or first side view illustrating a state in which the frame and the cylinder are coupled to each other according to an embodiment.
Figure 9:
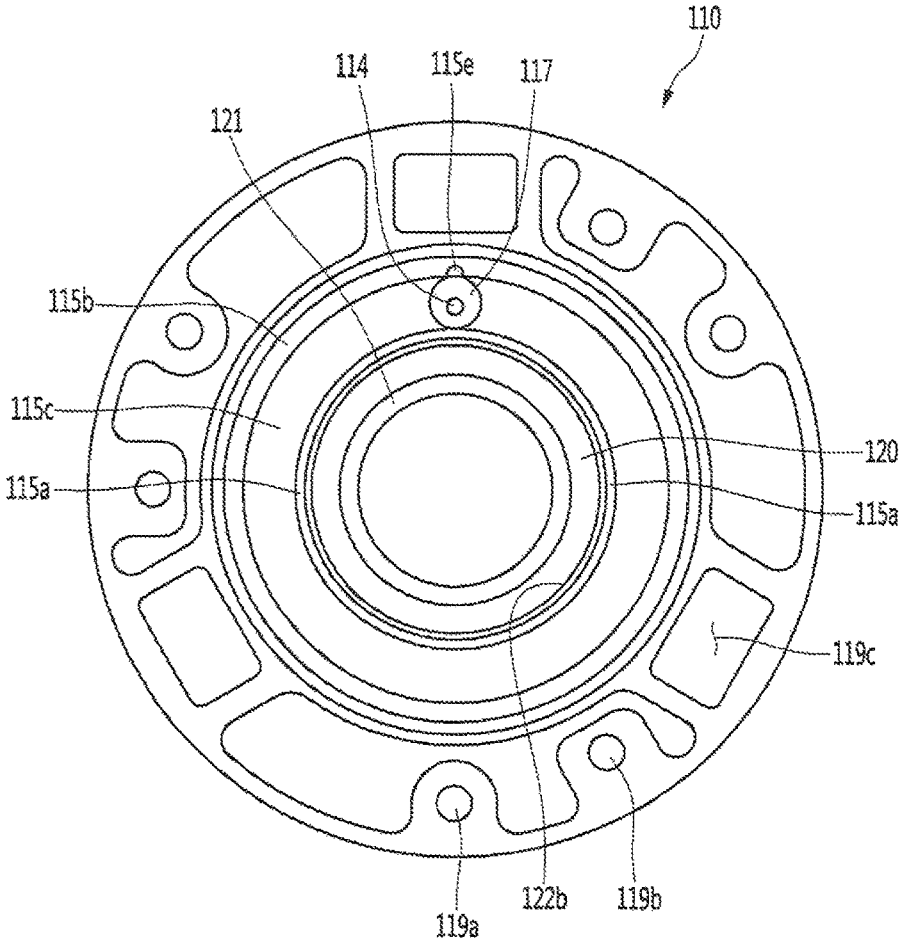
FIG. 9 is a left or second side view illustrating a state in which the frame and the cylinder are coupled to each other according to an embodiment.
Figure 10:
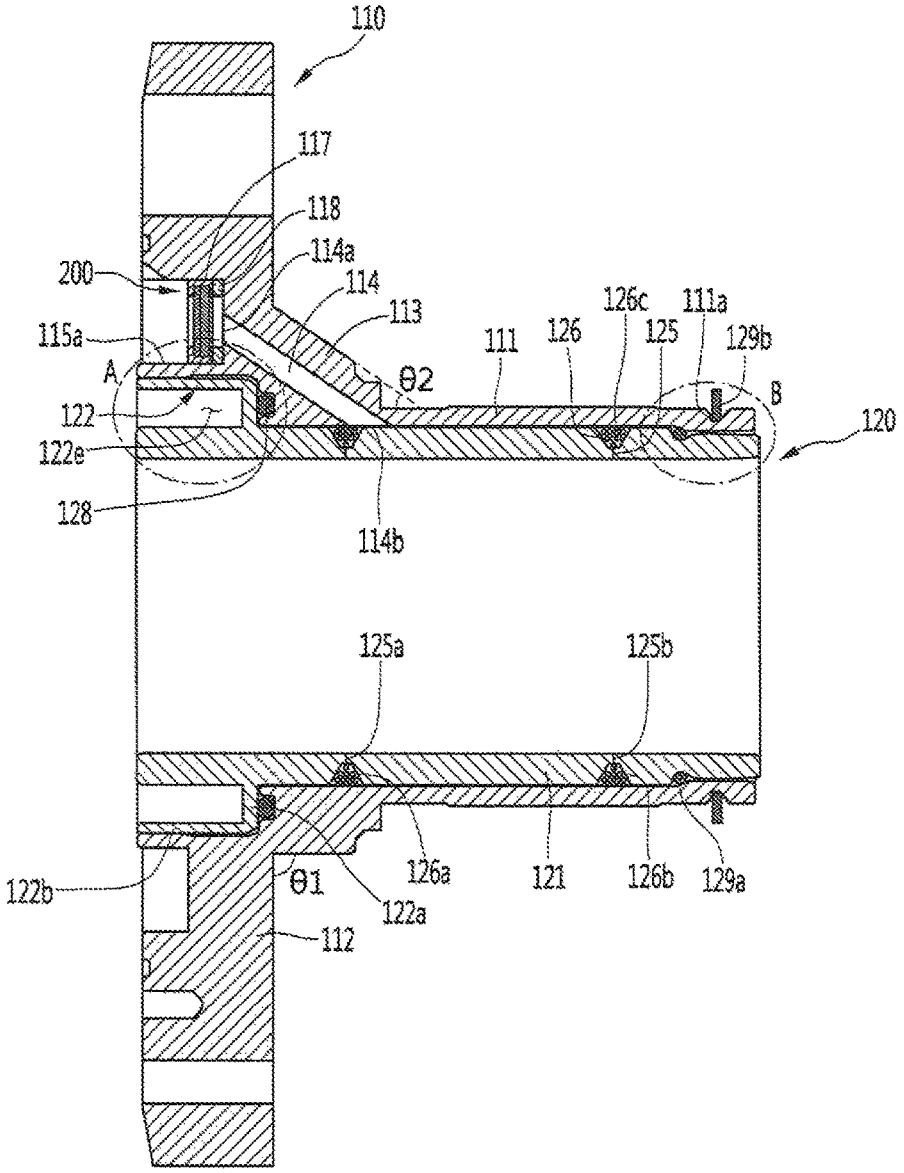
FIG. 10 is a cross-sectional view illustrating a state in which the frame and the cylinder are coupled to each other according to an embodiment.

FIG. 5 is a perspective view illustrating a state in which a frame and a cylinder are coupled to each other according to an embodiment. FIG. 6 is an exploded perspective view illustrating the frame and the cylinder according to an embodiment. FIG. 7 is a perspective view illustrating a state in which the frame and the cylinder are coupled to each other according to an embodiment. FIG. 8 is a right or first side view illustrating a state in which the frame and the cylinder are coupled to each other according to an embodiment. FIG. 9 is a left or second side view illustrating a state in which the frame and the cylinder are coupled to each other according to an embodiment. FIG. 10 is a cross-sectional view illustrating, a state in which the frame and the cylinder are coupled to each other according to an embodiment.

Referring to FIGS. 5 to 10, the cylinder 120 according to an embodiment may be coupled to the frame 110. For example, the cylinder 120 may be inserted into the frame 110.

The frame 110 may include a frame body 111 that extends in the axial direction and a frame flange 112 that extends outward from the frame body 111 in the radial direction. That is, the frame flange 112 may extend from an outer circumferential surface of the frame body 111 at a first preset or predetermined angle θ1. For example, the first preset angle θ1 may be about 90°.

The frame body 111 may have a cylindrical shape with a central axis in the axial direction and a body accommodation part or portion that accommodates the cylinder body 121. A third installation groove 111*a* into which the fourth sealing member 129*b* disposed or provided between the frame body 111 and the inner stator 148 may be inserted may be defined in or at a rear portion of the frame body 111.

The frame flange 112 may include a first wall 115*a* having a ring shape and coupled to the cylinder flange 122, a second wall 115*b* having a ring shape and disposed to surround the first wall 115*a*, and a third wall 115*c* that connects a rear end of the first wall 115*a* to a rear end of the second wall 115*b*. Each of the first wall 115*a* and the second wall 115*b* may extend in the axial direction, and the third wall 115*c* may extend in the radial direction.

A frame space part or space 115*d* may be defined by the first to third walls 115*a*, 115*b*, and 115*c*. The frame space part 115*d* may be recessed backward from a front end of the frame flange 112 to form a portion of the discharge passage through which the refrigerant discharged through the discharge valve 161 may flow.

A second installation groove 116*b* which may be defined in a front end of the second wall 115*b* and in which the first sealing ember 127 may be installed or provided may be defined in the frame flange 112.

A cylinder accommodation part or portion 111*b*, into which at least portion of the cylinder 120, for example, the cylinder flange 122 may be inserted, may be defined in an inner space of the first wall 115*a*. For example, an inner diameter of the cylinder accommodation part 111*b* may be equal to or slightly less than an outer diameter of the cylinder flange 122.

When the cylinder 120 is press-fitted into the frame 110, the cylinder flange 122 may interfere with the first wall 115*a*. In this process, the cylinder flange 122 may be deformed.

The frame flange 112 may further include a sealing member seating part or seat 116 that extends inward from a rear end of the first wall 115*a* in the radial direction. A first installation groove 116*a*, into which the second sealing member 128 may be inserted, may be defined in the sealing member seating part 116. The first installation groove 116*a* may be recessed rearward from the sealing member seating, part 116.

The frame flange 112 may further include coupling holes 119*a* and 119*b* which a predetermined coupling member that couples the frame 110 to peripheral parts or components may be coupled. A plurality of the coupling holes 119*a* and 119*b* may be provided along an outer circumference of the second wall 115*b*.

The coupling holes 119*a* and 119*b* may include a first coupling hole 119*a* to which the cover coupling member 149*a* may be coupled. A plurality of the first coupling hole 119*a* may be provided, and the plurality of first coupling holes 119*a* may be disposed or provided to be spaced apart from each other. For example, three first coupling holes 119*a* may be provided.

The coupling holes 119*a* and 119*b* may further include a second coupling hole 119*b* to which a predetermined coupling member that couples the discharge cover 160 to the frame 110 may be coupled. A plurality of the second coupling hole 119*b* may be provided, and the plurality of second coupling holes 119*b* may be disposed or provided to be spaced apart from each other. For example, three second coupling holes 119*b* may be provided.

As the three first coupling holes 119*a* and the three second coupling holes 119*b* may be defined along the outer circumference of the frame flange 112, that is, uniformly defined in a circumferential direction with respect to a central portion C1 of the frame 110, the frame 110 may be supported at three points of the peripheral parts or components, that is, the stator cover 149 and the discharge cover 60, and thus, stably coupled.

The frame flange 112 may include a terminal insertion part or portion 119*c* that provides a withdrawing, path for a terminal part or portion 141*d* of the motor assembly 140. The terminal insertion part 119*c* may be formed such that the frame flange 112 is cut out in the frontward and rearward direction. The terminal part 141*d* may extend forward from the coil 141*c* and be inserted into the terminal insertion part 119*c*. Thus, the terminal part 141*d* may be exposed to the outside from the motor assembly 140 and the frame 110 and connected to a cable, which may be directed to the terminal 108.

A plurality of the terminal insertion part 119*c* may be provided. The plurality of terminal insertion parts 119*c* may be disposed or provided along the outer circumference of the second wall 115*b*. Only one terminal insertion part 119*c* into which the terminal part 141*d* is inserted, of the plurality of terminal insertion parts 119*c* may be provided. The remaining terminal insertion parts 119*c* may be understood as components for preventing the frame 110 from being deformed.

For example, three terminal insertion parts 119*c* may be provided in the frame flange 112. In the three terminal insertion parts 119*c*, the terminal part 141*d* may be inserted into one terminal insertion part 119*c*, and the terminal part 141*d* may not be inserted into the remaining two terminal insertion parts 119*c*.

When the frame 110 is pled to the stator cover 149 or the discharge cover 160 or when the cylinder 120 is press-fitted into the frame 110, a large stress may be applied to the frame 110. If only one terminal insertion part 119*c* is provided in the frame flange 112, the stress may be concentrated on or at a specific point, causing deformation of the frame flange 112. Thus, in this embodiment, the three terminal insertion parts 119*c* may be provided in the frame flange 112, that is, uniformly disposed in the circumferential direction with respect to the central portion C1 of the frame 110 to prevent the stress from being concentrated.

The frame 110 may further include a frame connection part or portion 113 that extends at an incline from the frame flange 112 to the frame body 111. An outer surface of the frame connection part 113 may extend at a second preset or predetermined angle θ2 with respect to the outer circumferential surface of the frame body 111, that is, in the axial direction. For example, the second preset angle θ2 may be greater than about 0° and less than about 90°.

A gas hole 114 that guides the refrigerant discharged from the discharge valve 161 to a gas inflow part or inflow 126 of the cylinder 120 may be defined in the frame connection part 113. The gas hole 114 may pass through the inside of the frame connection part 113.

The gas hole 114 may extend from the frame flange 112 up to the frame body 111 via the frame connection part 113. As the gas hole 114 may be defined by passing through a portion of the frame having a relatively thick thickness up to the frame flange 112, the frame connection part 113, and the frame body 111, the frame 110 may be prevented from being reduced in strength due to the formation of the gas hole 114. An extension direction of the gas hole 114 may correspond to an extension direction of the frame connection part 113 to form the second preset angle θ2 with respect to the inner circumferential surface of the frame body 111, that is, in the axial direction.

A discharge filter 200 that filters foreign substances from the refrigerant introduced into the gas hole 114 may be disposed or provided on or in an inlet part or inlet of the gas hole 114. The discharge filter 200 may be installed or provided on the third wall 115*c*.

The discharge filter 200 may be installed or provided on or in a filter groove 117 defined in the frame flange 112. The filter groove 117 may be recessed backward from the third wall 115*c* and have a shape corresponding to a shape of the discharge filter 200.

That is, an inlet part or inlet 114*a* of the gas hole 114 may be connected to the filter groove 117, and the gas hole 114 may pass through the frame flange 112 and the frame connection part 113 from the filter groove 117 to extend to the inner circumferential surface of the frame body 111. Thus, an outlet part or outlet 114*b* of the gas hole 114 may communicate with the inner circumferential surface of the frame body 111.

The linear compressor 10 may further include a filter sealing member or seal 118 installed at a rear side, that is, an outlet side of the discharge filter 200. The filter sealing member 118 may have an approximately ring shape. The filter sealing member 118 may be placed on or in the filter groove 117. When the discharge filter 200 presses the filter groove 117, the filter sealing member 118 may be press-fitted into the filter groove 117.

A plurality of the frame connection part 113 may be provided along a circumference of the frame body 111. Only one frame connection part 113, in which the gas hole 114 may be defined, of the plurality of frame connection parts 113 may be provided. The remaining frame connection parts 113 may be understood as components that prevent the frame 110 from being deformed.

For example, the frame 110 may include a first frame connection part or portion 113*a*, a second frame connection part or portion 113*b*, and a third part of portion connection frame 113*c*. Among them, the gas hole 114 may be provided in the first frame connection part 113*a*, and the gas hole 114 may not be provided in the second and third frame connection parts 113*b* and 113*c*.

When the frame 110 is coupled to the stator cover 149 or discharge cover 160 or when the cylinder 120 is press-fitted into the frame 110, a large stress may be applied to the frame 110. If only one frame connection part 113 is provided in the frame flange 112 the stress may be concentrated on or at a specific point, causing deformation of the frame 110. Thus, in this embodiment, the three frame connection parts 113 may be provided in the frame body 111, that is, uniformly disposed or provided in the circumferential direction with respect to the central portion C1 of the frame 110 to prevent the stress from being concentrated.

The cylinder 120 may be coupled to the inside of the frame 110. For example, the cylinder 120 may be coupled to the frame 110 through a press-fitting process.

The cylinder 120 may include a cylinder body 121 that extends in the axial direction and cylinder flange 122 disposed or provided outside of a front portion of the cylinder body 121. The cylinder body 121 may have a cylindrical shape with a central axis or central longitudinal axis in the axial direction and may be inserted into the frame body 111. Thus, an outer circumferential surface of the cylinder body 121 may be disposed or provided to face an inner circumferential surface of the frame body 111.

The gas inflow part 126 into which the gas refrigerant flowing through the gas hole 114 may be introduced may be provided in the cylinder body 121. The linear compressor 10 may further include a gas pocket (see reference numeral 110*b* of FIG. 12) disposed or provided between the inner circumferential surface of the frame 110 and the outer circumferential surface of the cylinder 120 so that the gas used as the bearing may flow therein. A cooling gas passage from the outlet part 114*b* of the gas hole 114 to the gas inflow part 126 may define at least a portion of the gas pocket 110*b*. Also, the gas inflow part 126 may be disposed or provided at an inlet side of a cylinder nozzle 125, which will be described hereinafter.

The gas inflow part 126 may be recessed inward from the outer circumferential surface of the cylinder body 121 in the radial reaction. The gas inflow part 126 may have a circular shape along the outer circumferential surface of the cylinder body 121 with respect to the central axis in the axial direction.

A plurality of the gas inflow part 126 may be provided. For example, two gas inflow parts 126 may be provided. A first gas inflow part inflow 126*a* of the two gas inflow parts 126 may be disposed or provided on or at a front portion of the cylinder body 121, that is, at a position which is close to the discharge valve 161, and a second gas inflow part or inflow 126*b* may be disposed or provided on or at a rear portion of the cylinder body 121, that is, at a position which is close to a compressor suction side of the refrigerant. That is, the first gas inflow part 126*a* may be disposed or provided at a front side with respect to a central portion in the frontward and rearward direction of the cylinder body 121, and the second gas inflow part 126*b* may be disposed at a rear side.

On the other hand, the first gas inflow part 126*a* may be disposed or provided at a position which is adjacent to the outlet part 114*b* of the gas hole 114. That is, a distance from the outlet part 114*b* of the gas hole 114 to the first gas inflow part 126*a* may be less than a distance from the outlet part 114*b* to the second gas inflow part 126*b*.

An internal pressure of the cylinder 120 may be relatively high at a position which is close to the discharge side of the refrigerant, that is, an inside of the first gas inflow part 126*a*. Thus, the outlet part 114*b* of the gas hole 114 may be disposed or provided adjacent to the first gas inflow part 126*a*, so that a relatively large amount of refrigerant may be introduced toward the inner central portion of the cylinder 120 through the first gas inflow part 126*a*. As a result, a function of the gas bearing may be enhanced. Also, while the piston 130 reciprocates, abrasion between the cylinder 120 and the piston 130 may be prevented.

A cylinder filter member or filter 126*c* may be installed or provided on or in the gas inflow part 126. The cylinder filter member 126*c* may prevent a foreign substance having a predetermined size or more from being introduced into the cylinder 120 and perform a function of adsorbing oil contained in the refrigerant. The predetermined size may be about 1 μm.

The cylinder filter member 126*c* may include a thread which is wound around the gas inflow part 126. The thread may be made of a polyethylene terephthalate (PET) material and have a predetermined thickness or diameter.

The thickness or diameter of the thread may be determined to have adequate dimensions in consideration of strength of a the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow part 126 when the thread is wound.

The cylinder body 121 may further include cylinder nozzle 125 that extends inward from the gas inflow part 126 in the radial direction. The cylinder nozzle 125 may extend up to the inner circumferential surface of the cylinder body 121.

The cylinder nozzle 125 may include a first nozzle part or nozzle 125*a* that extends from the first gas inflow part 126*a* to the inner circumferential surface of the cylinder body 121 and a second nozzle part or nozzle 125*b* that extends from the second gas inflow part 126*b* to the inner circumferential surface of the cylinder body 121.

The refrigerant, which is filtered by the cylinder filter member 126*c* while passing through the first gas inflow part 126*a* may be introduced into a space between the inner circumferential surface of the first cylinder body 121 and the outer circumferential surface of the piston body 131 through the first nozzle part 125*a*. Also, the refrigerant which is filtered by the cylinder filter member 126*c* while passing through the second gas inflow part 126*b* may be introduced into a space between the inner circumferential surface of the first cylinder body 121 and the outer circumferential surface of the piston body 131 through the second nozzle part 125*b*. The gas refrigerant flowing to the outer circumferential surface of the piston body 131 through the first and second nozzle parts 125*a* and 125*b* may provide a lifting force to the piston 130 to perform a function as the gas bearing with respect to the piston 130.

The cylinder flange 122 may include a first flange 122*a* that extends outward from the flange coupling part (see reference numeral 121*c* of FIG. 11) of the cylinder body 121 in the radial direction, and a second flange 122*b* that extends forward from the first flange 122*a*. A cylinder front part or portion 121*a* of the cylinder body 121 and the first and second flanges 122*a* and 122*b* may define a deformable space part or space 122*e* which is deformable when the cylinder 120 is press-fitted into the frame 110.

The second flange 122*b* may be press-fitted into an inner surface of the first wall 115*a* of the frame 110. That is, press-fitting parts or portions 115*h* and 122*d* may be formed on an inner surface of the first wall 115*a* and an outer surface of the second flange 122*b*. During the press-fitting process, the second flange 122*b* may be deformable toward the deformable space part 122*e*. As the second flange 122*b* is spaced apart from the outside of the cylinder body 121, the cylinder body 121 may not be affected even when the second flange 122*b* is deformed. Thus, the cylinder body 121 mutually operating with the piston 130 may not be deformed by the gas bearing.

The cylinder body 121 may define a cylinder front part or portion 121*a* on or at a front side, and a cylinder rear part or portion 121*b* on or at a rear side with respect to the flange coupling part 121*c*.

A guide groove 115*e* for easily processing the gas hole 114 may be defined in the frame flange 112. The guide groove 115*e* may be formed by recessing at least a portion of the second wall 115*b* and defined in an edge of the filter groove 117.

While the gas hole 114 is processed, a processing mechanism may be drilled from, the filter groove 117 to the frame connection part 113. The processing mechanism may interfere with the second wall 115*b*, causing a limitation in that the drilling is not easy. Thus, in this embodiment, the guide groove 115*e* may be defined in the second wall 115*b*, and the processing mechanism may be disposed in the guide groove 115*e* so that the gas hole 114 may be easily processed.

Figure 11:
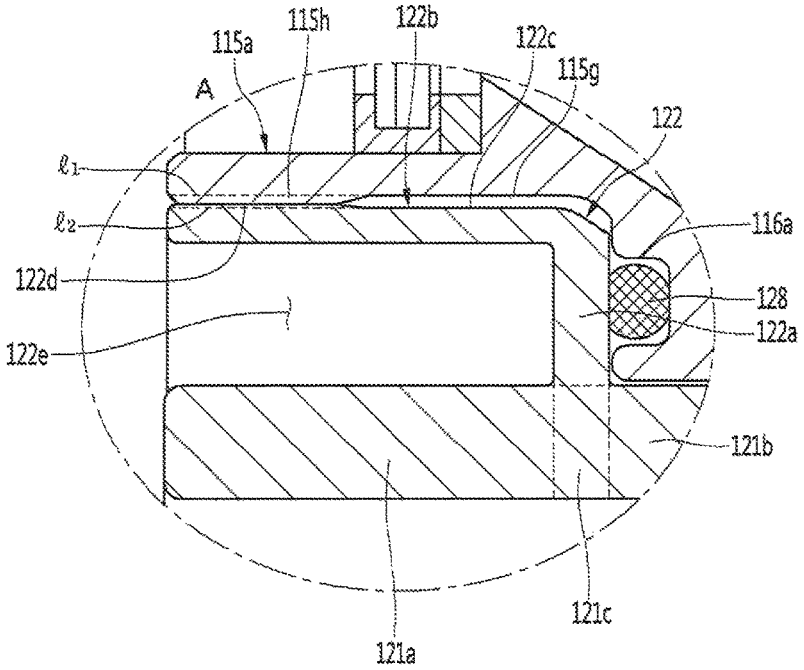
FIG. 11 is an enlarged view illustrating a portion A of FIG. 10.
Figure 12:
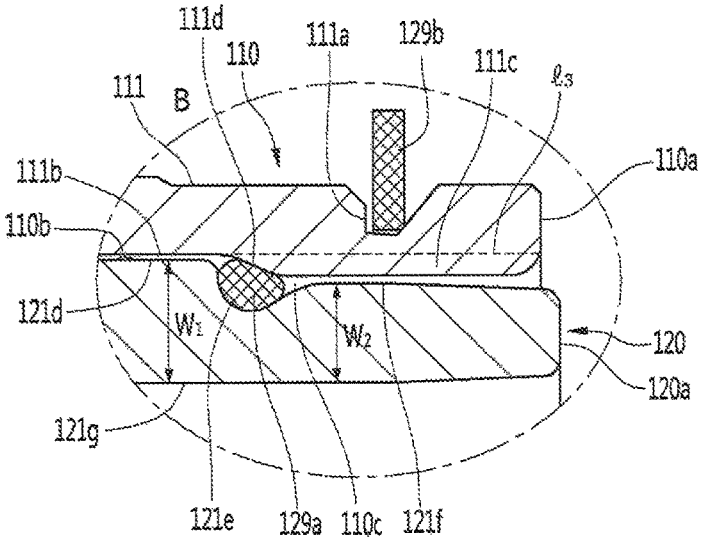
FIG. 12 is an enlarged view illustrating a portion B of FIG. 10.
Figure 13:
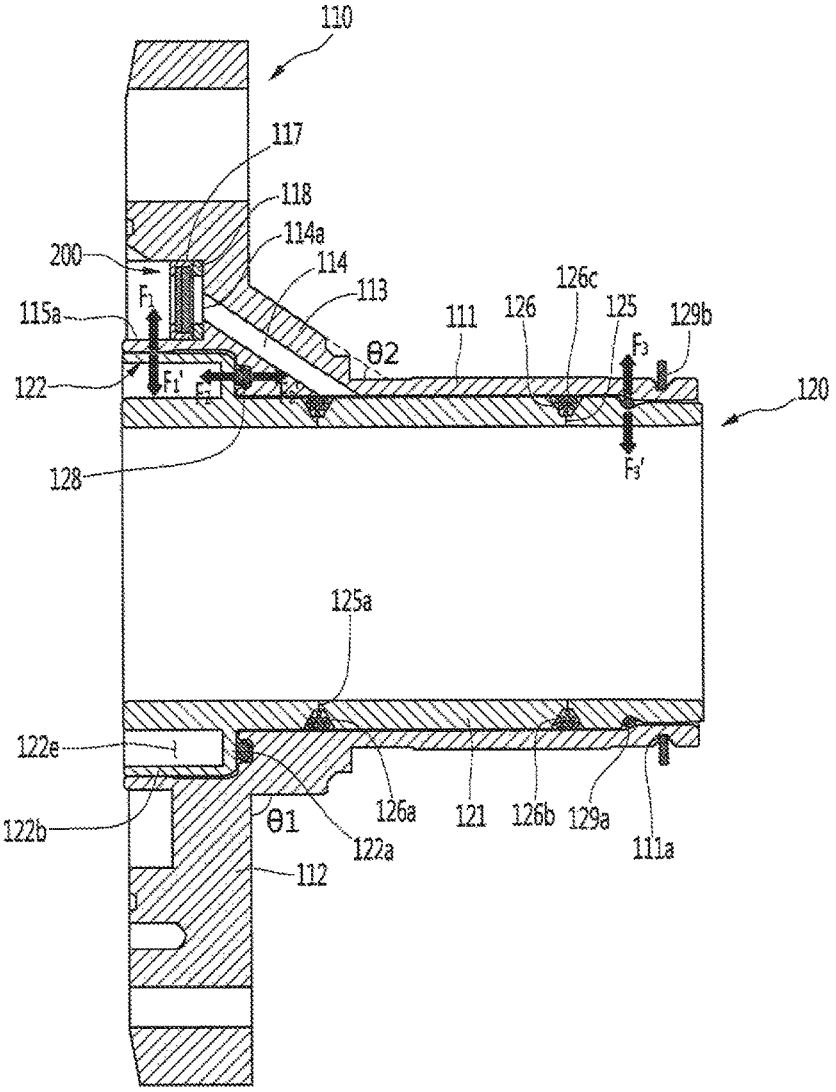
FIG. 13 is a cross-sectional view illustrating an action of a force between the frame and the cylinder in a state in which the frame and the cylinder are coupled to each other according to an embodiment.
Figure 14:
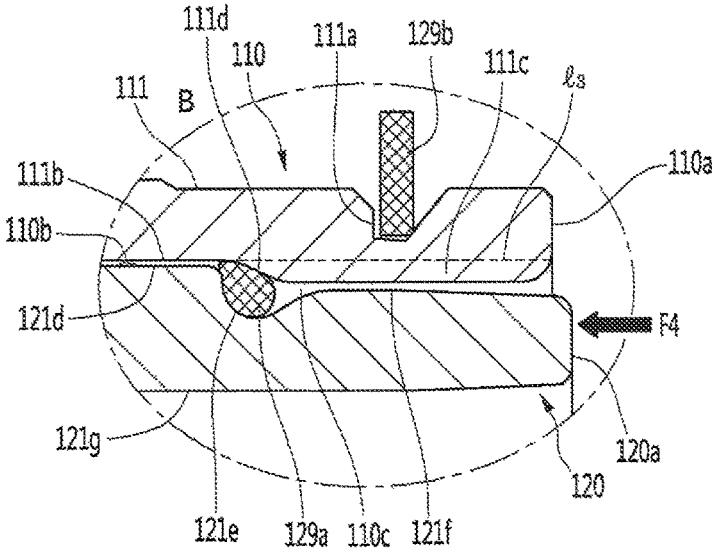
FIG. 14 is a cross-sectional view illustrating a state in which a separation of the cylinder is prevented by a reaction force even when a force is applied to a rear end of the cylinder according to an embodiment.

FIG. 11 is an enlarged view illustrating a portion A of FIG. 10, FIG. 12 is an enlarged view illustrating a portion B of FIG. 10, FIG. 13 is a cross-sectional view illustrating an action of a force between the frame and the cylinder in a state in which the frame and the cylinder are coupled to each other according to an embodiment. FIG. 14 is a cross-sectional view illustrating a state in which a separation of the cylinder is prevented by a reaction force even when a force is applied to a rear end of the cylinder according to an embodiment.

Referring to FIG. 11, the cylinder body 121 according to an embodiment may include flange coupling part 121*c* to which the cylinder flange 122 may be coupled, cylinder front part 121*a* defining a front portion of the flange coupling part 121*c*, and cylinder rear part 121*b* defining a rear portion of the flange coupling part 121*c*.

The frame 110 and the cylinder 120 may be coupled to each other by press-fit. For example, the first wall 115*a* of the frame 110 and the cylinder flange 122 of the cylinder 120 may be press-fitted.

The first wall 115*a* of the frame 110 may include a wall body 115*g* that surrounds the second flange 122*b*, and a first press-fitting part 115*h* that protrudes from an inner circumferential surface of the wall body 115*g*. The first press-fitting part 115*h* may protrude inward from the inner circumferential surface of the wall body 115*g* in the radial direction with respect to a first virtual line ℓ 1 extending forward from the inner circumferential surface of the wall body 115*g* In other words, the first press-fitting part 115*h* may protrude from the inner circumferential surface of the wall body 115*g* in a direction approaching the second press-fitting part 122*d* of the second flange 122*b*. The first press-fitting part 115*h* that, extend from one point of the wall body 115*g* to a front end of the first wall 115*a*.

The second flange 122*b* of the cylinder 120 may include flange body 122*c* surrounded by the first wall 115*a* and second press-fitting part 122*d* that protrudes from an outer circumferential surface of the flange body 122*c*. The second press-fitting part 122*d* may protrude outward from the outer circumferential surface of the flange body 122*c* in the radial direction with respect to a second virtual line ℓ 2 extending forward from the outer circumferential surface of the flange body 122*c*. In other words, the second press-fitting part 122*d* may protrude from the outer circumferential surface of the flange body 122*c* in a direction approaching the first press-fitting part 155*h*. The second press-fitting part 122*d* may extend from one point of the flange body 122*c* to a front end of the second flange 122*b*.

When the cylinder 120 is inserted into the frame 110, the first press-fitting part 115*h* and the second press-fitting part 122*d* may interfere with each other. In this case, a direction in which the cylinder 120 is inserted may be a direction in which the cylinder body 121 is inserted into the frame body 111 via the cylinder accommodation part 111*b*, that is, a right direction in FIG. 6.

The outer diameter of the frame body 111 may be slightly greater than the inner diameter of the cylinder body 121. A size of a space corresponding to a distance obtained by subtracting, the inner diameter of the cylinder body 121 from the outer diameter of the frame body 111 may form a volume of the gas pocket 110*b*.

The inner diameter of the wall body 115*g* may be slightly greater than the outer diameter of the flange body 122*c*. On the other hand, the inner diameter of the first press-fitting part 115*h* may be equal to or greater than the outer diameter of the second press-fitting part 122*d*.

Thus the cylinder 120 may be relatively easily inserted until before the first press-fitting part 115*h* and the second press-fitting part 122*d* interfere with each other. However, if the first press-fitting part 115*h* and the second press-fitting part 122*d* begin to interfere with each other, the cylinder 120 may be inserted when a force having a preset or predetermined magnitude or more is applied. The force having the preset magnitude may be determined based on protruding lengths of the first and second press-fitting parts 115*h* and 122*d*.

In the process of being press-fitted with the first and second press-fitting parts 115*h* and 122*d*, the cylinder flange 122 or the first wall 115*a* may be deformed by reaction forces F1 and F1' acting on each other. Even when the first wall 115*a* is deformed, an amount of deformation may be damped by the deformable space part 122*e*. Thus, the cylinder body 121 may not be deformed. Therefore, there is an advantage that it does not affect the performance of the gas bearing.

When the cylinder 120 is inserted up to a position where the press-fitting between the first and second press-fitting parts 115*h* and 122*d* is completed, the rear end of the first flange 122*a* may come into close contact with the second sealing member 128. The second sealing member 128 may prevent the cylinder 120 or the frame 110 from being deformed or damaged when the cylinder 120 and the frame 110 are coupled to each other. Reaction forces F2 and F2' through the second sealing member 128 may increase a coupling force between the cylinder 120 and the frame 110.

Referring to FIG. 12, the frame 110 according to an embodiment may include frame body 111 surrounding the cylinder body 121. The frame body 111 may include a frame inner circumferential surface 111*b* facing a first outer circumferential surface 121*d* of the cylinder rear part 121*b*.

A sealing pocket 110*c* in which the gas pocket 110*b* and the third sealing member 129*a* may be installed, may be provided in a space part or space between the first outer circumferential surface 121*d* and the frame inner circumferential surface 111*b*. The sealing pocket 110*c* may be defined on or at a rear side of the gas pocket 110*b*. The sealing pocket 110*c* may be understood as a space between the cylinder groove 121*e* and the sealing member pressing part 111*c*, in particular, a press inclination part or portion 111*d*.

A height of the sealing pocket 110*c* in the radial direction may be less than a diameter of the third sealing member 129*a*. Therefore, the third sealing member 129*a* may be disposed in a state of being compressed or deformed within the sealing pocket 110*c*.

The frame 119 may further include the sealing member pressing part 111*c* that protrudes from the frame inner circumferential surface 111*b* of the frame body 111 and presses the third sealing member 129*a*. The sealing member pressing part 11*c* may protrude inward from the frame inner circumferential surface 111*b* in the radial direction with respect to a third virtual line $\ell$ 3 extending rearward from the frame inner circumferential surface 111*b*. In other words, the sealing member pressing part 111*c* may protrude from the frame inner circumferential surface 111*b* in a direction approaching the third sealing member 129*a* or the second outer circumferential surface 121*f* of the cylinder rear part 121*b*.

The sealing member pressing part 111*c* may extend from one point of the frame body 111, that is, a boundary point between the gas pocket 110*b* and the sealing pocket 110*c*, to the rear end 110*a* of the frame 110. The sealing member pressing part 111*c* may include the press inclination part 111*d* extending at an incline inward in the radial direction. The press inclination part 111*d* may be formed in or at a rear portion of the sealing member pressing part 111*c* and may be disposed to surround the cylinder groove 121*e*.

That is, due to the press inclination part 111*d*, the sealing member pressing part 111*c* may gradually protrude toward the rear side. According to such structure, as insertion of the cylinder 120 progresses, a pressing force transferred from the sealing member pressing part 111*c* to the third sealing member 129*a* may gradually increase.

The outer circumferential surface of the cylinder rear part 121*b* may include first and second circumferential surfaces 121*d* and 121*f* and cylinder groove 121*e* between the first and second outer circumferential surfaces 121*d* and 121*f*. The cylinder groove 121*e* may have a shape recessed from the first and second circumferential surfaces 121*d* and 121*f*.

The first outer circumferential surface 121*d* may be understood as an outer circumferential surface extending rearward from the flange coupling part 121*c* toward the cylinder groove 121*e*. The second outer circumferential surface 121*f* may be understood as an outer circumferential surface extending from the cylinder groove 121*e* ward a rear end 120*a* of the cylinder 120.

A thickness w1 of the cylinder rear part 121*b* where the first outer inferential surface 121*d* is positioned may be greater than a thickness w2 of the cylinder rear part 121*b* where the second outer circumferential surface 121*f* is positioned. That is, a shortest distance between the first outer circumferential surface 121*d* and the inner circumferential surface 121*g* of the cylinder 120 may be longer than a shortest distance between the second outer circumferential surface 121*d* and the inner circumferential surface 121*g*.

In other words, as the sealing member pressing part 111*c* extends from the cylinder groove 121*e* to face the second outer circumferential surface 121*f* and the sealing member pressing part 111*c* protrudes from the inner circumferential surface of the frame 110, a radius of the second outer circumferential surface 121*f* of the cylinder 120 may be less than a radius of the first outer circumferential surface 121*e*. According to such structure, the cylinder 120 may be easily inserted into the frame 110, and the third sealing member 129*a* may be easily pressed by the sealing member pressing part 111*c*.

Pressing-fitting between the third sealing member 129*a* and the sealing member pressing part 111*c* may be easily achieved. When the third sealing member 129*a* is installed on the cylinder groove 121*e*, the third sealing member 129*a* may further protrude outward than the outer circumferential surface of the cylinder body 121, that is, the second outer circumferential surface 121.

In this state, the cylinder 120 may be inserted into the frame 110. When the third sealing member 129*a* reaches the sealing member pressing part 111*c* of the frame 110, the sealing member pressing part 111*c* may press the third sealing member 129*a*, thereby resulting in deformation of the third sealing member 129*a*. As a result, the third sealing member 129*a* may fill the space of the cylinder groove 121*e*.

On the other hand, a time point when the third sealing member 129*a* and the sealing member pressing part 111*c* are press-fitted may correspond to a time point when the first and second press-fitting parts 115*h* and 122*d* interfere with each other. That is, when the first and second press-fitting parts 115*h* and 122*d* interfere with each other, the third sealing member 129*a* may be pressed by the sealing member pressing part 111*c* of the frame 110. When the press-fitting of the cylinder 120 is completed, the third sealing member 129*a* may come into close contact with the frame 110 and the cylinder 120 by restoration force (reaction forces F3 and F3').

According to the above-described structure and the press-fitting process, as the rear portion of the cylinder 120 may strongly contact the frame 110, the coupling force between the cylinder 120 and the frame 110 may increase and it is possible to prevent the cylinder 120 from being separated from the frame 110.

As the third sealing member 129*a* seals a rear space of the gas pocket 110*b*, the refrigerant flowing through the gas pocket 110*b* may be prevented from leaking to the rear side of the cylinder 120 and the frame 110. Therefore, a performance of the gas bearing may be improved.

Referring to FIG. 14, when a force F4 directed forward from the rear end 120*a* of the cylinder 120 is applied during operation of the linear compressor 10, the third sealing member 129*a* may be moved toward the gas pocket 110*b* in the space between the cylinder groove 121*e* and the press inclination part 111*d*, and thus, be strongly contacted (indicated by a dashed line). As a result, the sealing force of the third sealing member 129*a* may be maintained, and it is possible to prevent the third sealing member 129*a* from being loosened in the space between the cylinder groove 121*e* and the press inclination part 111*d*.

Figure 15:
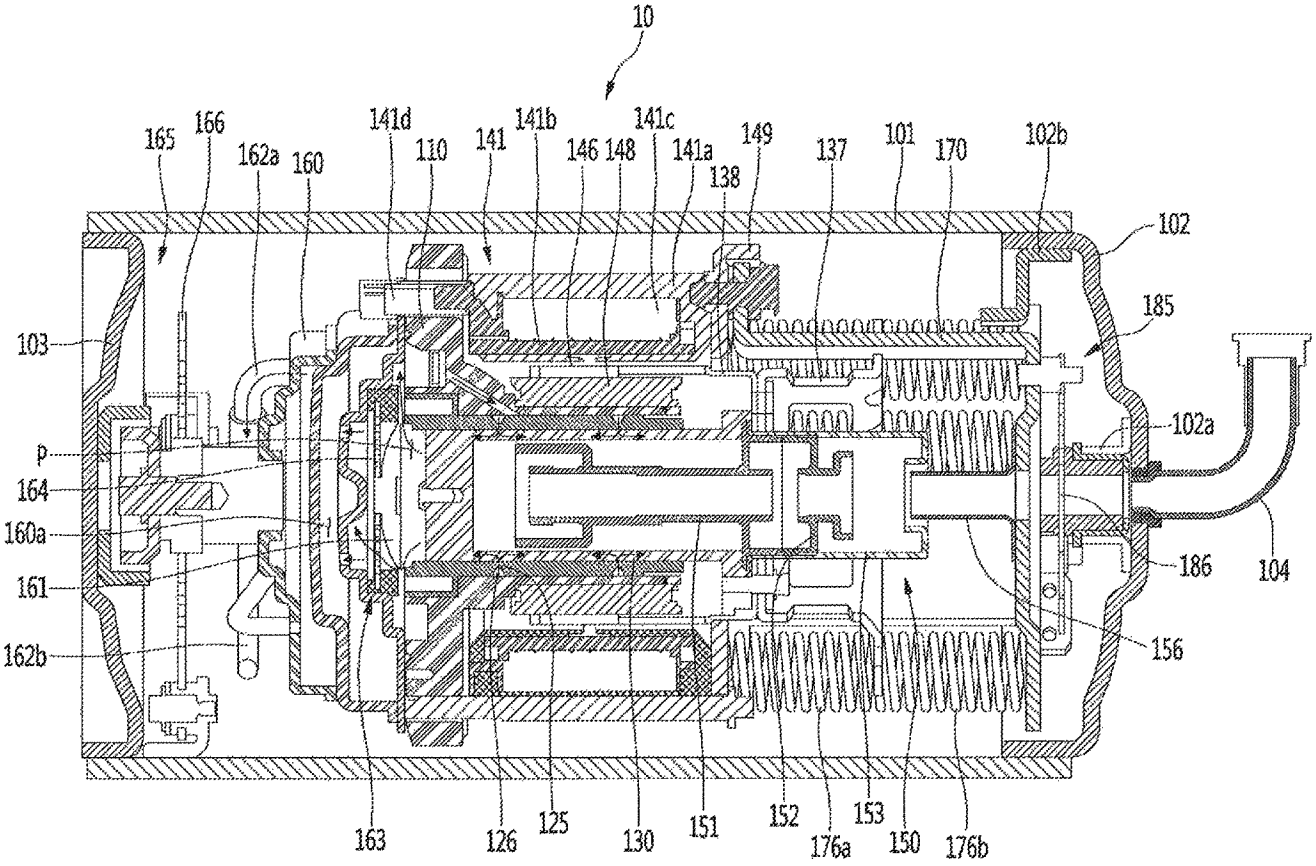
FIG. 15 is a cross-sectional view illustrating a state in which a refrigerant flows in the linear compressor according to an embodiment.

FIG. 15 is a cross-sectional view illustrating a state in which a refrigerant flows in the linear compressor according to an embodiment. The flow of the refrigerant in the linear compressor 10 according to an embodiment will be described with reference to FIG. 15. The refrigerant suctioned into the shell 101 through the suction pipe 104 may flow into the piston 130 via the suction muffler 150. At this time, when the motor assembly 140 is driven, the piston 130 may reciprocate in the axial direction.

When the suction valve 135 coupled to the front side of the piston 130 is opened the refrigerant may be introduced and compressed in the compression space P. When the discharge valve 161 is opened, the compressed refrigerant may be discharged from the compression space P, and a portion of the discharged refrigerant may flow toward the frame space part 115*d* of the frame 110. Most of the remaining refrigerant may pass through the discharge space 160*a* of the discharge cover 160 and be discharged through the discharge pipe 105 via the cover pipe 162*a* and the loop pipe 162*b*.

On the other hand, the refrigerant of the frame space part 115*d* may flow rearward and passes through the discharge filter 200. In this process, foreign substances or oil contained in the refrigerant may be filtered.

The refrigerant passing through the discharge filter 200 may flow into the gas hole 114, may be supplied between the inner circumferential surface of the cylinder 120 and the outer circumferential surface of the piston 130, and perform a gas bearing function. According to such an operation, the bearing function may be performed using at least a portion of the discharged refrigerant, without using oil, thereby preventing abrasion of the piston or the cylinder.

According to embodiments disclosed herein, the compressor including internal parts or components may be decreased in size to reduce a volume of a machine room of a refrigerator, and thus, an inner storage space of the refrigerator may be increased. Also, the drive frequency of the compressor may be increased to prevent the internal parts or components from being deteriorated in performance due to the decreased size thereof. In addition, the gas bearing may be applied between the cylinder and the piston to reduce a friction force generated by the oil.

The third sealing member may be installed or provided between the rear end of the cylinder and the rear end of the frame, that is, on or at the rear side of the gas pocket, thereby preventing external leakage of the refrigerant of the gas pocket and increasing a coupling force between the frame and the cylinder. The cylinder groove for installing the third sealing member may be formed in or at the rear portion of the cylinder and the inner circumferential surface of the frame may press the third sealing member. Thus, the sealing member may be maintained in a state of being pressed as much as a preset or predetermined amount, thereby improving a sealing effect by the sealing member.

As the third sealing member may be effectively pressed by the press inclination part provided, on the inner circumferential surface of the frame, a contact force between the frame and the cylinder may be improved by the third sealing member. Also, when force is applied from the rear end to the front end of the cylinder, the third sealing member is rolled toward the gas pocket, thereby maintaining the sealing force of the third sealing member and preventing the third sealing member from being loosened in the space between the frame and the cylinder.

As the cylinder and the frame is assembled by the press-fitting process, it is possible to achieve a stable coupling between the cylinder and the frame and prevent leakage of refrigerant through the coupling portion between the cylinder and the frame. Further, as the cylinder flange extends outward from the cylinder body to secure the deformable space part between the cylinder body and the cylinder flange, the cylinder body mutually operating with the piston may not be deformed even though the cylinder flange is deformed during the press-fitting process. Furthermore, as the sealing members are provided in the front portion and the rear portion of the cylinder, the refrigerant flowing to the gas pocket between the cylinder and the frame may not leak out through the front portion and the rear portion of the cylinder.

The coupling force between the cylinder and the frame may be increased by the force applied from the sealing member to the cylinder and the frame. Also, the second sealing member may be stably seated on the frame flange, and an impulse occurring between the cylinder flange and the frame flange during the press-fitting of the cylinder and the frame may be absorbed by the second sealing member, thereby reducing damage or deformation in the cylinder or the frame.

As the plurality of frame connection parts may be uniformly disposed in the frame along the outer circumferential surface of the frame body, it is possible to prevent stress concentration on or at a specific position during the press-fitting process of the cylinder and the frame, thereby preventing deformation of the frame. As the plurality of terminal insertion parts are uniformly disposed in the frame flange along the circumferential surface of the frame flange, it is possible to prevent stress concentration on or at a specific position during the press-fitting process of the cylinder and the frame, thereby preventing deformation of the frame. Also, due to the press-fitting process of the cylinder and the frame, an assembling process may be simplified and assembling cost reduced.

Embodiments disclosed herein provide a linear compressor in which a frame and a cylinder may be stably coupled to each other. Embodiments disclosed herein also provide a linear compressor capable of preventing deformation of a cylinder body in a press-fitting process of a frame and a cylinder.

Embodiments disclosed herein further provide a linear compressor capable of preventing external leakage of a refrigerant gas discharged through a discharge valve and reducing pressure loss in a process of supplying a refrigerant gas to a nozzle of a cylinder. Embodiments disclosed herein also provide a linear compressor capable of preventing external leakage of a refrigerant used for a gas bearing by appropriately sealing a gas pocket between a frame and a cylinder. Embodiments disclosed herein additionally provide a linear compressor in which a work process of a cylinder and a frame may be simple and a low work expense is involved.

Embodiments disclosed herein provide a linear compressor that may include a cylinder; a frame coupled to an outer side of the cylinder; a cylinder groove defined on an outer circumferential surface of the cylinder; and a sealing member or seal installed or provided on or in the cylinder groove. The sealing member may be installed or provided between the outer circumferential surface of the cylinder and an inner circumferential surface of the frame. The frame may includes a frame body, and a sealing member pressing part or portion that protrudes from the inner circumferential surface of the frame body and presses the sealing member. The sealing member pressing part may protrude from the inner circumferential surface of the frame body in a direction approaching the outer circumferential surface of the cylinder.

The linear compressor may further include, between the inner circumferential surface of the frame body and the outer circumferential surface of the cylinder, a gas pocket and a sealing pocket that defines an installation space of the sealing member. A height of the sealing pocket in a radial direction may be less than a diameter of the sealing member.

The sealing member pressing part may include a press inclination part or portion that extends at an incline in the radial direction and presses the sealing member. The sealing member pressing part may gradually protrude toward the end of the frame due to the press inclination part.

The outer circumferential surface of the cylinder may include a first outer circumferential surface provided on or at a front side of the cylinder groove and a second outer circumferential surface provided or at on a rear side of the cylinder groove, and a thickness (w1) of the cylinder where the first outer circumferential surface is positioned may be greater than a thickness (w2) of the cylinder where the second outer circumferential surface is positioned.

Embodiments disclosed herein further provide a linear compressor that may include a cylinder which defines a cylinder groove; a frame coupled to an outer side of the cylinder; and a sealing member or seal installed or provided on or in the cylinder groove and pressed by the frame. A space part or space between an outer circumferential surface of the cylinder and an inner circumferential surface of the frame may include a gas pocket through which a refrigerant gas may flow, and a sealing pocket in which the sealing member may be installed or provided.

The frame may include a press inclination part or portion that protrudes from the inner circumferential surface of the frame toward the outer circumferential surface of the cylinder and that extends at an incline inward in a radial direction. The press inclination part may surround the cylinder groove. The sealing pocket may be defined in space between the cylinder groove and the press inclination part.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fail within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a piston that reciprocates in an axial direction;

a cylinder into which the piston is inserted and which defines a compression space for a refrigerant;

a frame coupled to an outer side of the cylinder;

a cylinder groove defined on an outer circumferential surface of the cylinder; and a sealing member provided in the cylinder groove, wherein the sealing member is provided between the outer circumferential surface of the cylinder and an inner circumferential surface of the frame.

2. The linear compressor according to claim 1, wherein the frame includes:

a frame body having an inner circumferential surface that surrounds the cylinder; and a sealing member pressing portion that protrudes from the inner circumferential surface of the frame body and presses the sealing member.

3. The linear compressor according to claim 2, wherein the sealing member pressing portion protrudes from the inner circumferential surface of the frame body in a direction toward the outer circumferential surface of the cylinder.

4. The linear compressor according to claim 3, wherein a space between the inner circumferential surface of the frame body and the outer circumferential surface of the cylinder includes:

a gas pocket through which a refrigerant gas flows; and a sealing pocket that defines an installation space for the sealing member.

5. The linear compressor according to claim 4, wherein the sealing member pressing portion extends from a boundary point between the gas pocket and the sealing pocket to an end of the frame.

6. The linear compressor according to claim 4, wherein a height of the sealing pocket in a radial direction is less than a diameter of the sealing member such that the sealing member is positioned in a state of being compressed or deformed within the sealing pocket.

7. The linear compressor according to claim 6, wherein the sealing member pressing portion includes a press inclination portion that extends at an incline in a radial direction and presses the sealing member.

8. The linear compressor according to claim 1, wherein the outer circumferential surface of the cylinder includes a first outer circumferential surface provided at a front side of the cylinder groove and a second outer circumferential surface provided at a rear side of the cylinder groove, and wherein a thickness of the cylinder at the first outer circumferential surface is greater than a thickness of the cylinder at the second outer circumferential surface.

9. The linear compressor according to claim 1, further including:

an installation groove defined on the outer circumferential surface of the frame; and a sealing member provided in the installation groove to seal a space between an inner stator and the installation groove.

10. The linear compressor according to claim 1, wherein the cylinder includes:

a cylinder body that defines the compression space for the refrigerant and having the cylinder groove; and a cylinder flange that extends from the cylinder body in a radial direction.

11. The linear compressor according to claim 10, wherein the frame includes:

a frame body into which the cylinder body is inserted; and a press-fitting portion press-fitted into the cylinder flange.

12. A linear compressor, comprising:

a piston that reciprocates in an axial direction;

a cylinder into which the piston is inserted and which defines a cylinder groove;

a frame coupled to an outer side of the cylinder; and a sealing member provided in the cylinder groove, the sealing member being pressed by the frame, wherein a space between an outer circumferential surface of the cylinder and an inner circumferential surface of the frame includes:

a gas pocket through which a refrigerant gas flows; and a sealing pocket in which the sealing member is provided.

13. The linear compressor according to claim 12, wherein the frame includes a press inclination portion that protrudes from the inner circumferential surface of the frame toward the outer circumferential surface of the cylinder and extends at an incline inward in a radial direction.

14. The linear compressor according to claim 13, wherein the press inclination portion surrounds the cylinder groove.

15. The linear compressor according to claim 13, wherein the sealing pocket is defined in a space between the cylinder groove and the press inclination portion.

16. A linear compressor, comprising:

a piston that reciprocates in an axial direction;

a cylinder into which the piston is inserted and which defines a compression space for a refrigerant;

a frame coupled to an outer side of the cylinder;

a cylinder groove defined on an outer circumferential surface of the cylinder; and a sealing member provided in the cylinder groove, wherein the sealing member is provided between the outer circumferential surface of the cylinder and an inner circumferential surface of the frame, wherein the outer circumferential surface of the cylinder includes a first outer circumferential surface provided at a front side of the cylinder groove and a second outer circumferential surface provided at a rear side of the cylinder groove, and wherein a thickness of the cylinder at the first outer circumferential surface is different than a thickness of the cylinder at the second outer circumferential surface.

17. The linear compressor according to claim 16, wherein a space between the inner circumferential surface of the frame body and the outer circumferential surface of the cylinder includes:

a gas pocket through which a refrigerant gas flows; and a sealing pocket that defines an installation space for the sealing member.

18. The linear compressor according to claim 17, wherein the frame comprises:

a frame body having an inner circumferential surface that surrounds the cylinder; and a sealing member pressing portion that protrudes from the inner circumferential surface of the frame body and presses the sealing member, wherein the sealing member pressing portion extends from a boundary point between the gas pocket and the sealing pocket to an end of the frame.

19. The linear compressor according to claim 17, wherein a height of the sealing pocket in a radial direction is less than a diameter of the sealing member such that the sealing member is positioned in a state of being compressed or deformed within the sealing pocket.

20. The linear compressor according to claim 18, wherein the sealing member pressing portion includes a press inclination portion that extends at an incline in a radial direction and presses the sealing member.

* * * * *